US011613955B2

(12) United States Patent
Yendell et al.

(10) Patent No.: US 11,613,955 B2
(45) Date of Patent: Mar. 28, 2023

(54) SHEAR RAM WITH VERTICAL SHEAR CONTROL

(71) Applicant: Baker Hughes Oilfield Operations LLC, Houston, TX (US)

(72) Inventors: Elliot T. Yendell, Houston, TX (US); Gregory J. Myers, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/929,963

(22) Filed: Jul. 15, 2020

(65) Prior Publication Data

US 2022/0018204 A1 Jan. 20, 2022

(51) Int. Cl.
*E21B 33/06* (2006.01)
*E21B 29/04* (2006.01)

(52) U.S. Cl.
CPC ..... *E21B 33/063* (2013.01)

(58) Field of Classification Search
CPC ..... E21B 33/063
See application file for complete search history.

(56) References Cited

U.S. PATENT DOCUMENTS 895,778 A * 8/1908 Mayer ..... A47J 17/02 83/660
2,884,063 A * 4/1959 Stover ..... B23D 21/00 83/648
4,537,250 A * 8/1985 Troxell, Jr. ..... E21B 29/08 166/55
6,782,788 B1 * 8/2004 Kutchmarek ..... E06B 9/266 83/697
7,243,713 B2 * 7/2007 Isaacks ..... E21B 33/063 166/85.4
7,464,765 B2 * 12/2008 Isaacks ..... E21B 33/062 166/85.4
2007/0246215 A1 * 10/2007 Springett ..... E21B 33/063 166/298
2011/0226476 A1 * 9/2011 Springett ..... E21B 33/063 166/298
2011/0226477 A1 * 9/2011 Springett ..... E21B 33/063 166/298
2012/0043083 A1 * 2/2012 Jahnke ..... E21B 33/063 166/55.1
2022/0087708 A1 * 3/2022 Chen ..... A61B 17/32093

OTHER PUBLICATIONS

International Search Report and Written Opinion dated Mar. 3, 2022 in corresponding PCT Application No. PCT/US2021//050363.

* cited by examiner

*Primary Examiner* — Matthew Troutman
*Assistant Examiner* — Douglas S Wood
(74) *Attorney, Agent, or Firm* — Hogan Lovells US LLP

(57) ABSTRACT

A blade includes a blade body extending a blade length and having a blade depth. The blade also includes a flat, arranged at a forward face, extending a flat length, less than the blade length. The blade further includes at least one slant, arranged at the forward face, the at least one slant being coupled to the flat and positioned at a slant angle, wherein the at least one slant includes a cutting edge.

17 Claims, 6 Drawing Sheets

SHEAR RAM WITH VERTICAL SHEAR CONTROL

BACKGROUND

1. Field of Disclosure

This disclosure relates in general to oil and gas tools, and in particular, to rams used for blowout prevents (BOPs) in oil and gas wells.

2. Description of the Prior Art

Blowout preventers (BOPs) are typically used in surface and subsea drilling operations to protect an oil well from pressure surges. Generally, BOPs include a series of rams aligned with a central bore. A drill pipe extends through the central bore and into the well below the BOP. Each set of rams is typically positioned with one ram on either side of the central bore. Some rams are designed to seal against the drill string when closed, but not to cut the drill string. Other rams include blades, and are designed to shear the drill string (and anything else in the central bore) when the rams are closed to completely seal the top of the well. These are referred to as shear rams.

A typical BOP includes a bore that runs through the BOP and connects to a wellbore. Pipe and tools are introduced to the wellbore through the bore in the BOP. Generally, blind shear rams are included in a BOP stack, and are used to shear pipe or tools inside a bore where containment of the pressure within the bore is desirable, such as in a situation with an unexpected or undesirable pressure surge.

Blind shear rams typically include shear ram blocks that are mounted inside a housing, or bonnet, on the BOP. The shear ram blocks have blades that are attached to the front ends thereof, toward the bore. When the shear rams are activated, pistons push the shear ram blocks within the housing, causing the shear ram blocks and blades to close across the bore, simultaneously shearing any pipe, tools, or other objects in the bore and sealing the well. When the drill string, which is made of a tubular, is cut, it often flattens, which causes the diameter to expand. The pipe segments remaining in the wellbore are referred to as "fish" that may be subsequently recovered. The increased dimeters of the fish may be challenging to cover.

SUMMARY

Applicant recognized the problems noted above herein and conceived and developed embodiments of systems and methods, according to the present disclosure, for shear rams.

In an embodiment, a blowout preventer (BOP) assembly includes a body portion, a bore extending through the body portion, and a ram block assembly. The ram block assembly includes an upper ram block being movable into the bore, a lower ram block being movable into the bore, and blades arranged on each of the upper ram block and the lower ram block. The blades include respective blade profiles each having a flat, a first slant, and a second slant, the first slant being arranged between the flat and the second slant.

In an embodiment, a blade includes a blade body extending a blade length and having a blade depth. The blade also includes a flat, arranged at a forward face, extending a flat length, less than the blade length. The blade further includes at least one slant, arranged at the forward face, the at least one slant being coupled to the flat and positioned at a slant angle, wherein the at least one slant includes a cutting edge.

In an embodiment, a ram block assembly includes an upper ram block and a lower ram block. The assembly also includes an upper blade, coupled to the upper ram block. The upper blade includes an upper flat, the upper flat arranged at a forward face of the upper blade, an upper vertical portion of the upper flat, and at least one upper slant, coupled to the upper vertical portion, the at least one upper slant arranged at an upper angle with respect to the upper vertical portion. The assembly also includes a lower blade, coupled to the lower ram block. The lower blade includes a lower flat, the lower flat arranged at a forward face of the lower blade, a lower vertical portion of the lower flat, and at least one lower slant, coupled to the lower vertical portion, the at least one lower slant arranged at a lower angle with respect to the lower vertical portion.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
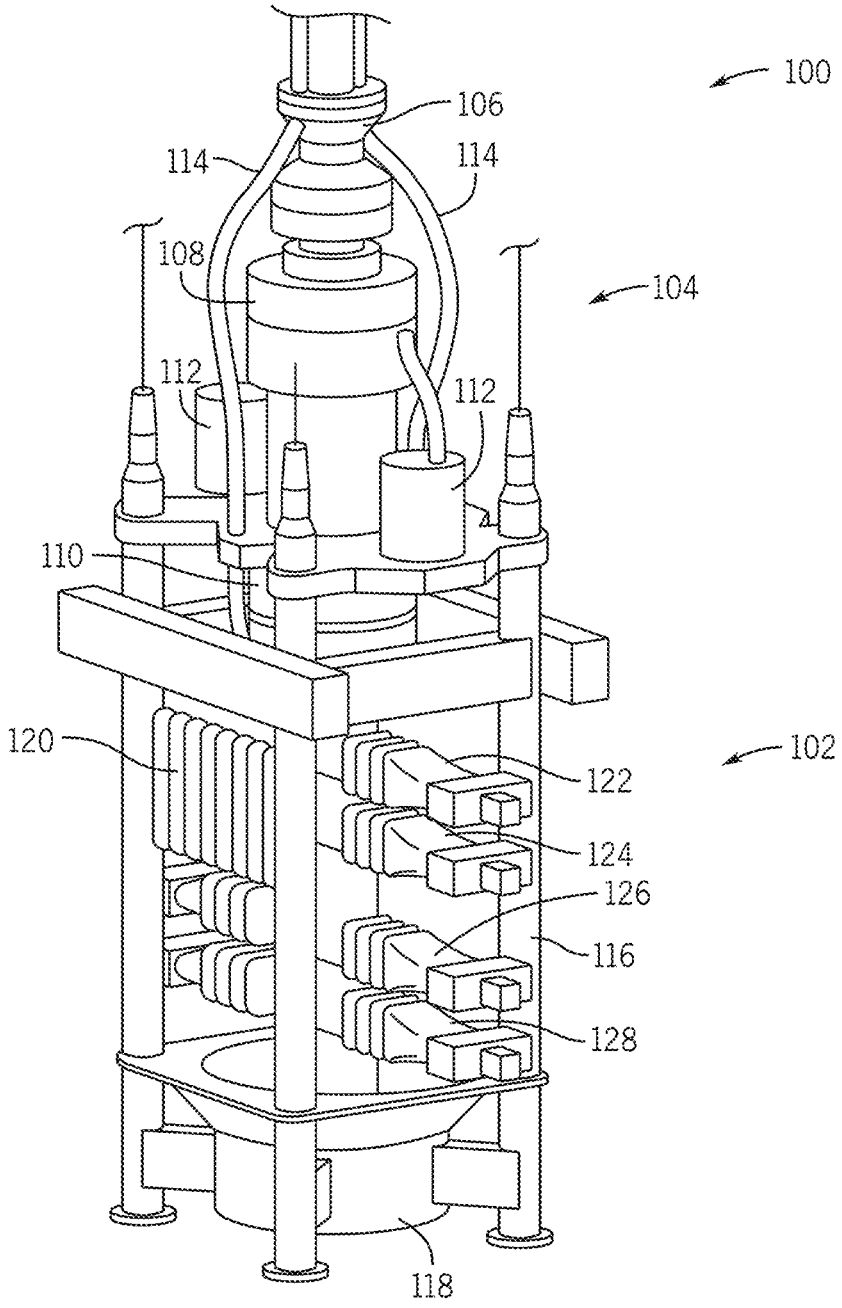
FIG. 1 is a perspective view of a BOP stack assembly attached to a wellhead, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations. Moreover, like reference numerals may be used for like items throughout the specification, however, such usage is for convenience and is not intended to limit the scope of the present disclosure.

Embodiments of the present disclosure are directed toward blades that may be incorporated into ram blocks to facilitate shearing wellbore tubulars with reduced shear force and/or shearing larger diameter pipes. In various embodiments, the blades include a vertical component that punctures a portion of the pipe before standard shearing begins. This configuration spreads out loading of the shear and, as a result, reduces closing forces. Additionally, expansion and spread of the tubular may be reduced, which facilitates subsequent recovery operations. The vertical portion may be referred to as a flat and may include a substantially squared off portion of the blade. The flat and/or vertical portion do not include cutting edges, in various embodiments, but in certain embodiments cutting edges may be utilized with embodiments of flat.

FIG. 1, there is shown a typical subsea BOP assembly 100, including a lower stack assembly 102, and an upper stack assembly 104, or lower marine riser package (LMRP). The upper stack assembly 104 may include, for example, a riser adapter 106, annular blowout preventers 108, 110, control pods 112, and choke and kill lines 114. The lower stack assembly 102 may include a frame 116 with a wellhead connector 118 at the lower end for connecting to a subsea wellhead assembly (not shown), as well as hydraulic accumulators 120. Typically, a bore runs through the BOP assembly, including through the upper and lower stack assemblies 102,104. The bore may contain a pipe, such as an elongated tubular. A shear ram housing 122 is normally located above pipe ram housings 124, 126, 128 on the lower stack assembly. The shear ram housing 122 contains shear upper and lower ram shear blocks attached to upper and lower blades. Each pipe ram housing 124, 126, 128 includes pipe ram blocks (not shown) with recesses (e.g., semicircular recesses) on the mating faces for closing around different size ranges of pipe. When open the shear and pipe ram blocks are positioned on either side of the bore. When closed, the shear ram blades seal off the bore. If pipe is present in the bore, the shear ram blades will shear the pipe.

Figure 2:
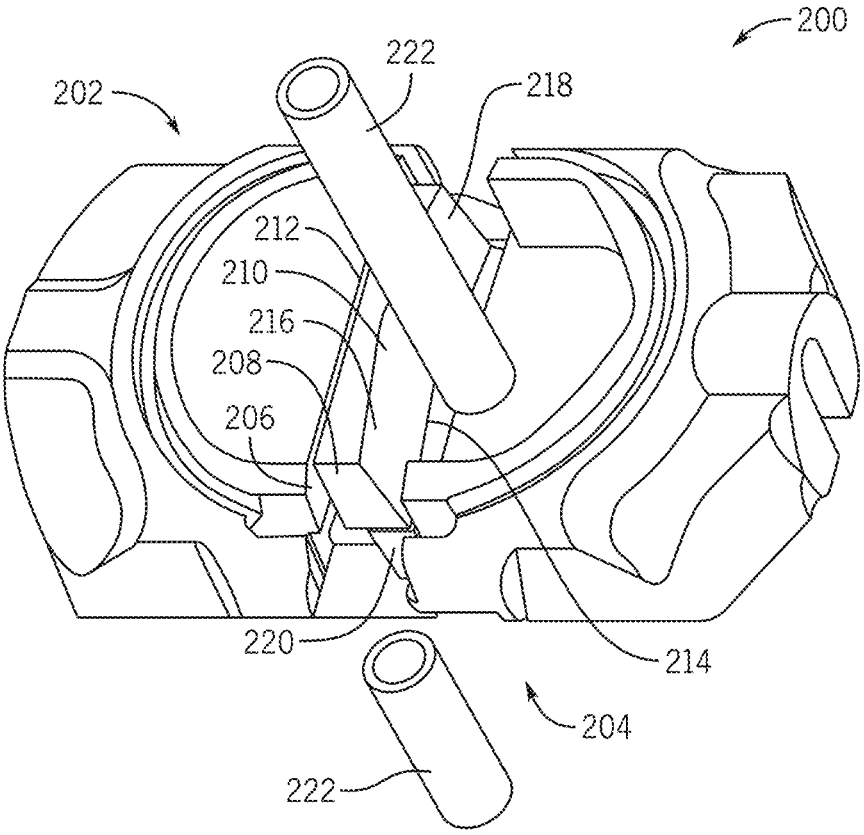
FIG. 2 is a perspective view of upper and lower blind shear rams in a closed position, including a sheared pipe, in accordance with embodiments of the present disclosure.

FIG. 2 is a perspective view of an embodiment of a ram block assembly 200 including an upper ram block 202 and a lower ram block 204. The illustrated ram blocks 202, 204 are removed from the shearing ram housing 122 in the illustrated embodiment and are shown in the closed position. The upper shear ram block 202 has a lateral surface that defines a face or forward end 206. An upper blade 208 mounts to the forward end 206 of the upper ram block 202. The upper blade 208 has a forward face 210 with an upper edge 212 and a lower forward edge 214. For purposes of this disclosure, the term forward, with reference to the ram blocks and associated components, shall mean from forward end 206 of upper shear ram block 202 toward the face 210 of the blade 208. In the example shown in FIG. 2, the lower forward edge 214 of the upper blade 208 extends farther forward from the forward end 206 of the upper shear ram block 202 than does upper edge 212. The face 210 of the upper blade 208 may also be generally concave or converging, resulting in the center of face 210 being recessed relative to the more forward portions of the face 210 at outer ends 216, 218. Of course, different shapes for the upper blade 208 may be employed. As may be seen, when the shear ram blocks 202, 204 are closed, the upper blade 208 overlaps with a lower blade 220, thereby shearing pipe 222 positioned between the ram blocks 202, 204 in the bore of the BOP. The sheared portions of the pipe 222 may be referred to as fish (e.g., an upper fish above the ram blocks 202, 204 and a lower fish below the ram blocks 202, 204)

As will be described herein, this configuration may present problems when the shapes of the blades 208, 220 do not adequately control the resultant pipe shape. For example, in various embodiments, the pipe 222 may expand in the area where the blades 208, 220 cut the pipe. That is, the shear force may drive expansion of a pipe diameter during the shearing process, which may create fish ends that are too large to move through other wellbore components. Furthermore, as noted above, as pipe diameters increase, the forces to shear the pipe may increase. While FIG. 2 illustrates a clean cut, it should be appreciated that, in operation, such cuts are often jagged, misshapen, and difficult to control, given the temperatures and pressures associated with the BOP. For example, the shape of a pipe end may expand and thereafter removal of the pipe 222 may be difficult because the newly formed end may have a larger diameter than other wellbore components. Embodiments of the present disclosure include improved blades for controlling the cut ends of the pipe to reduce or eliminate the expansion to enable pipes to be removed after shearing. Furthermore, embodiments may enable reduce shear forces and/or shearing of larger diameter pipes.

Figure 3A:
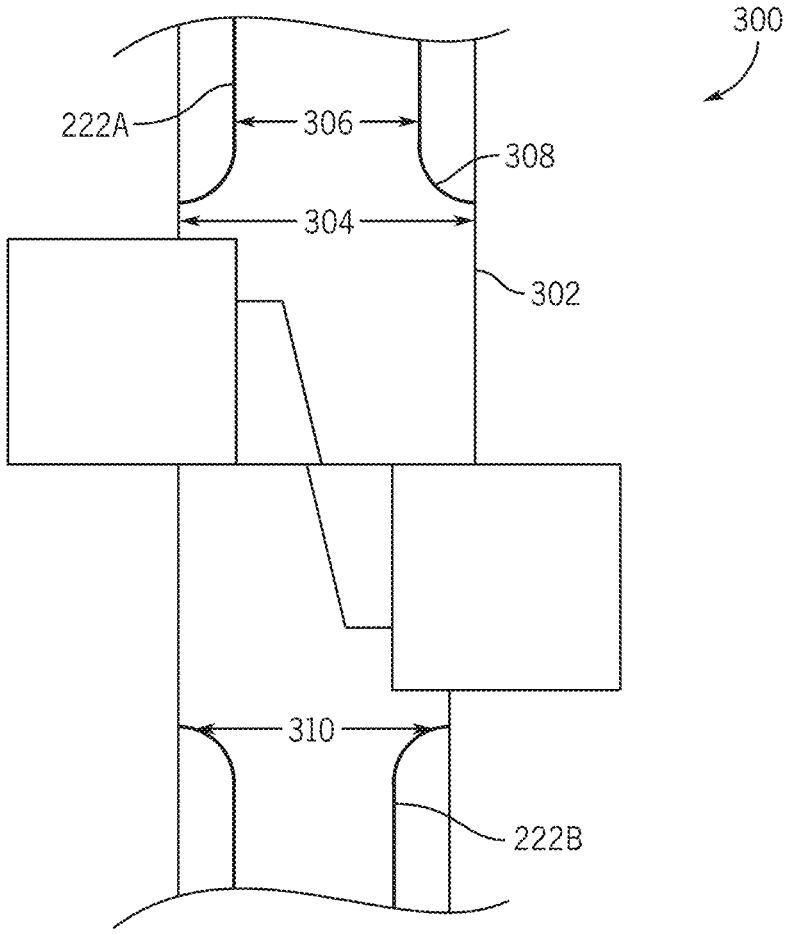
FIG. 3A is a schematic cross-sectional view of an embodiment of a shearing operation, in accordance with embodiments of the present disclosure.

FIG. 3A is a schematic side view of an embodiment of shearing operation 300 in which the blades 208, 220 have sheared the pipe 222. In the illustrated embodiment, the pipe 222 is arranged within a bore 302 of the BOP having an inner bore diameter 304. As shown, a pipe diameter 306 is less than the inner bore diameter 304, thereby enabling the pipe 222 to travel through the bore 302. The pipe 222 includes an upper fish 222A and a lower fish 222B. In the illustrated embodiment, the upper fish 222A is being retrieved from the wellbore. As shown, after the shearing operation, a sheared end 308 has expanded out to have an end diameter 310 that is substantially equal to the inner bore diameter 304. As a result, the pipe 222 may be suck within the bore during removal. This is undesirable for continued wellbore operations, which may increase costs. This may cause additional challenges when removing the lower fish 222B as well, as the lower fish 222B will also pass through the BOP, where the ends may damage or otherwise contact surfaces in the BOP. Embodiments of the present disclosure are directed toward systems and methods to reduce the expansion at the sheared end 308 to facilitate removal of the pipe 222. Furthermore, embodiments may enable a reduced shear force, which may facilitate shearing of larger diameter pipes.

Figure 3B:
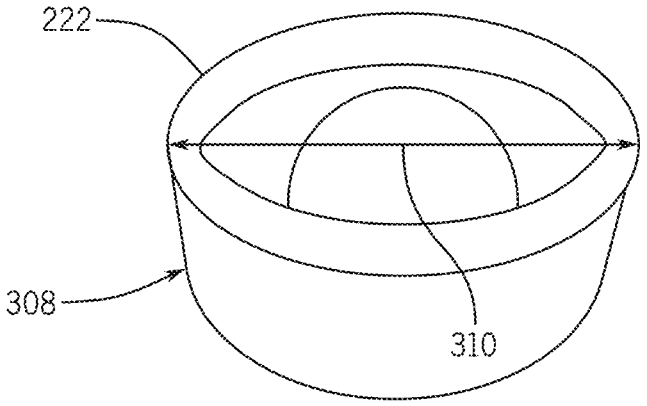
FIG. 3B is a perspective view of an embodiment of a pipe after a shearing operation, in accordance with embodiments of the present disclosure.

FIG. 3B is a schematic view of an embodiment of a pipe 222 illustrating an expanded end pipe diameter 310 after the pipe 222 has been sheared. The end diameter 310 is larger than the pipe diameter 306 (not pictured). Moreover, in the illustrated embodiment, the sheared end 308 has a fish-eyed and/or elliptical shape. As previously discussed, such an arrangement is undesirable because it may become lodged or stuck during removal operations and/or may scar or damage surfaces along the system.

Figure 4A:
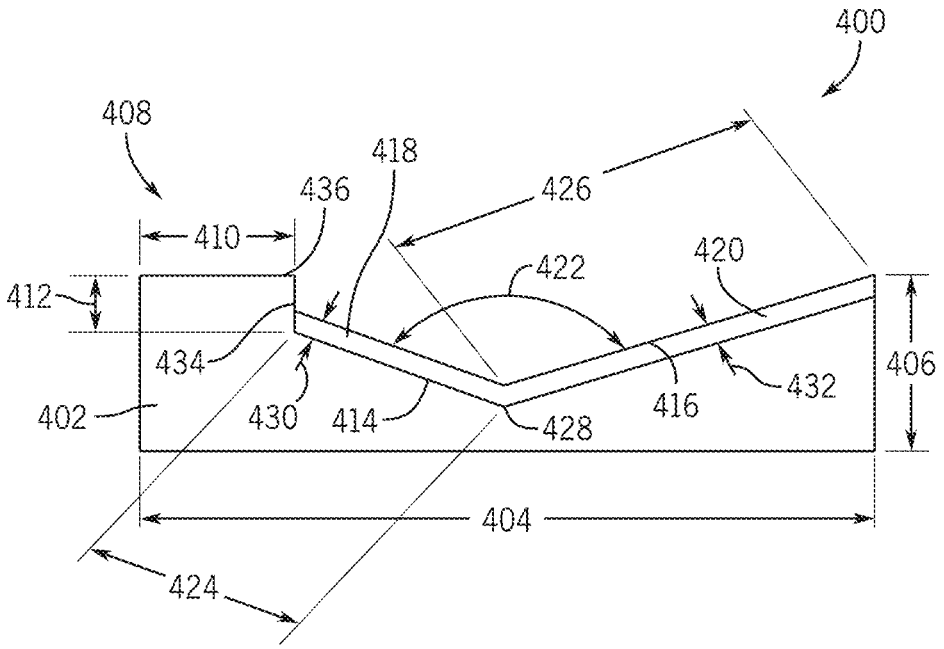
FIG. 4A is a schematic top plan view of an embodiment of a blade having a flat, in accordance with embodiments of the present disclosure.

FIG. 4A is a top plan view of an embodiment of a blade 400 that may be coupled to a shear block and/or integrally formed into a shear block. Embodiments of the blade 400 may include one or more features that control expansion and or fishing of pipes as they are sheared using the BOP. The illustrated blade 400 includes a body portion 402, which may include one or more apertures (not pictured) to fasten the blade 400 to a ram block. However, as noted above, the blade may also be integral to the ram block. The illustrated blade 400 has a blade length 404, which may be particularly selected based at least in part on an anticipated size of the pipes and/or BOP bores associated with the blade 400.

The illustrated blade 400 further includes a blade depth 406. In various embodiments, the blade depth 406 is particularly selected based on anticipated operating conditions. When comparing the blade 400 to the upper blade 208 of FIG. 2, it can be seen that the respective blade profiles differ. For example, the illustrated blade profile of the blade shown in FIG. 2 includes a flat 408 at the forward face of the blade 400. As noted above, the flat 408 may be utilized to puncture the pipe during shearing operations, which may reduce the shearing force used. The flat 408 extends for a flat length 410, which is less than the blade length 404. In various embodiments, the flat length 410 may be particularly selected based on operating conditions. For example, larger pipe diameters may drive modification of the flat length 410. In certain embodiments, the flat length 410 is approximately one-third of the blade length 404. However, such a length is provided for illustrative purposes only and it should be appreciated that other lengths may also be included. For example, the flat length 410 may be approximately one-eighth of the blade length 404, approximately one-fourth of the blade length 404, approximately one-half of the blade length 404, approximately two-thirds of the blade length 404, approximately three-fourths of the blade length 404, or any other reasonable size.

The illustrated flat 408 further has a flat depth 412, which is less than the blade depth 406. In various embodiments, the flat depth 412 is approximately one-fourth of the blade depth 406. That is, the flat depth 412, as will be described below, extends for the flat depth 412 along a vertical until it contacts a slant. The flat depth 412 may be any reasonable depth, such as approximately one-fifth of the blade depth 406, approximately one-third of the blade depth 406, approximately one-half of the blade depth 406, or any other reasonable depth.

The illustrated blade 400 includes a first slant 414 and a second slant 416, each of which include a respective first and second cutting edge 418, 420. As noted above, the cutting edge may be slanted away from the body 402 and may, moreover, slope away at any reasonable angle. In the illustrated embodiment, the first slant 414 and the second slant 416 are positioned at a slant angle 422. The illustrated slant angle is approximately 110 degrees, however, it should be appreciated that the slant angle 422 may be any reasonable degree. For example, the slant angle 422 may be approximately 100 degrees, approximately 110 degrees, approximately 115 degrees, approximately 120 degrees, approximately 125 degrees, approximately 130 degrees, or any other reasonable angle. Furthermore, the slant angle 422 may be between a range of approximately 100 degrees and 120 degrees, approximately 110 degrees and 130 degrees, approximately 120 degrees and 140 degrees, or any other reasonable range. Accordingly, the slant angle 422 may be particularly selected based on operating conditions.

As shown in FIG. 4A, there is no cutting edge on the flat 408. However, in other embodiments, the flat 408 may include a cutting edge to facilitate shearing on the pipe. The illustrated slants 414, 416 extend for a first slant length 424 and a second slant length 426. In various embodiments, the first slant length 424 is shorter than the second slant length 426. For example, in certain embodiments, the first and second slants 414, 416 meet at a midpoint 428. Because the flat length 410 occupies a portion of a half that includes the first slant 414, the second slant 416 may be longer. However, it should be appreciated that the first slant 414 and the second slant 416 may not meet at the midpoint 428, and as a result, the respective slant lengths 424, 426 may be particularly selected based on operating conditions. Further illustrated are cutting edge depths 430, 432, which are approximately equal in the illustrated embodiment, but may not be approximately equal in other embodiments. As noted above, the cutting edge depths 430, 432 may be particularly selected based on a slope. As will be described below, in operation, as or in embodiments before, the cutting edges 418, 420 shear the pipe, the pipe may contact the flat 408, which may puncture the pipe prior to full searing, thereby reducing a shearing force and also reducing expansion of the pipe.

In various embodiments, a vertical 434, corresponding to the flat depth 412, is arranged proximate the first slant 414. The vertical 434 may be utilized to limit expansion of the pipe during shearing operations. For example, a corner 436 may facilitate puncturing the pipe. It should be appreciated that the corner 436 is only illustrated as being 90 degrees, and in other embodiments, may be any other reasonable angle such as approximately 80 degrees, approximately 70 degrees, approximately 100 degrees, or the like. In various embodiments, the vertical 434 does not include a cutting edge, but it should be appreciated that embodiments may include a cutting edge along the vertical 434.

Figure 4B:
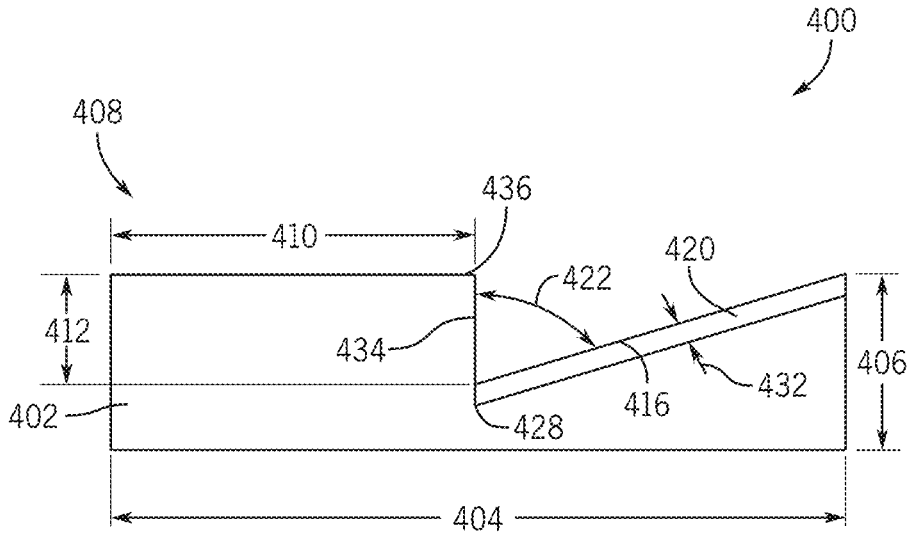
FIG. 4B is a schematic top plan view of an embodiment of a blade having a flat, in accordance with embodiments of the present disclosure.

FIG. 4B illustrates an embodiment of the blade 400 where the flat length 410 is approximately one-half of the blade length 404. As shown, in this embodiment, the first slant 414 has been removed and replaced by the flat 408. Furthermore, due to the removal of the first slant 414, the flat depth 412 is increased when compared to FIG. 4A. However, in this embodiment, the flat depth 412 is smaller than the blade depth 406. The illustrated second slant 416 is still arranged at the slant angle 422, which in this embodiment, is shown with respect to the vertical 434. The illustrated slant angle 422 is less than 90 degrees in this embodiment.

Figure 5A:
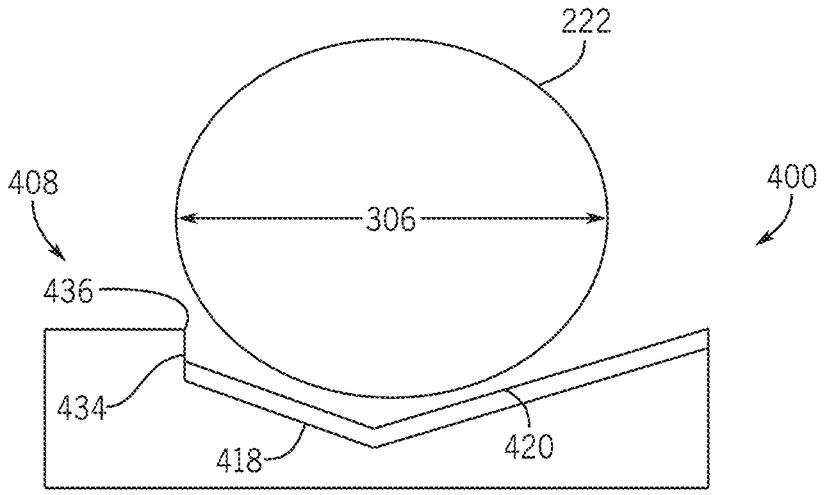
FIGS. 5A-5C are schematic top plan views of an embodiment of a shearing operation, in accordance with embodiments of the present disclosure.
Figure 5B:
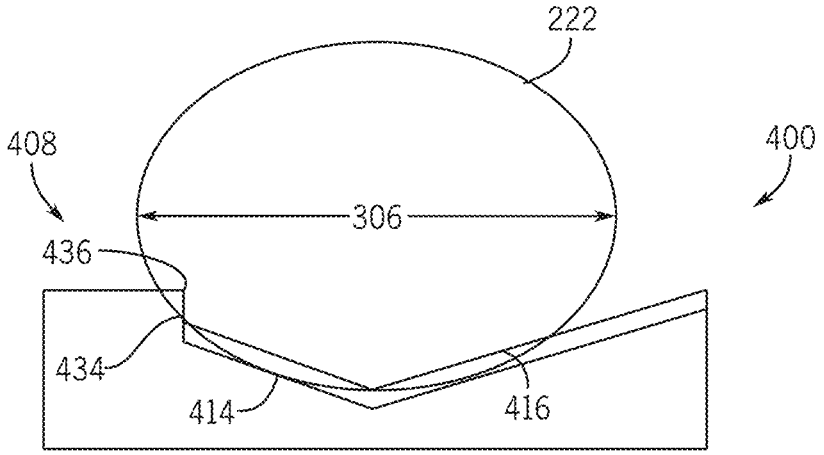
Figure 5C:
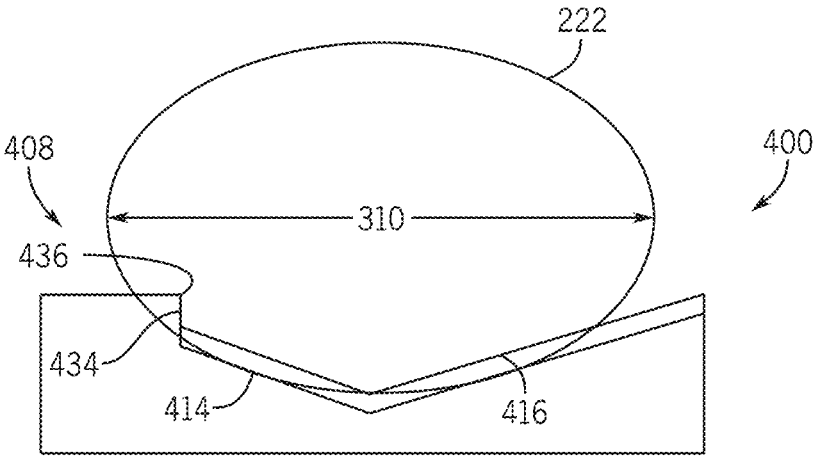

FIGS. 5A-5C illustrate a shearing sequence 500 where the pipe 222 is sheared along the blade 400. It should be appreciated that certain features have been removed for clarity, such as a mating blade, ram blocks, and the like. In various embodiments, when the BOP is activated the blade 400 is driven toward the pipe 222 such that the first and second cutting edges 418, 420 engage the pipe 222. As force is applied to the pipe 222, the pipe diameter 306 may increase. This increase is undesirable for recover operations because an end of the upper and lower fish may be too large to pass through other wellbore components. Moreover, as pipe diameter increases, larger forces may be used to shear the pipe 222. As noted above, embodiments of the present disclosure may reduce shearing forces while also controlling pipe expansion.

In FIG. 5A, the pipe 222 is beginning to contact the blade 400, for example, as the blade 400 is driven into the BOP via one or more pistons. In the illustrated embodiment, the inclusion of the flat 408 positions the flat 408 to engage the pipe 222 before the edges 418, 420. As noted above, such an arrangement may be desirable because the pipe 222 may be punctured prior to the standard shearing using the blade, thereby reducing the shearing forces and controlling pipe expansion.

FIG. 5B illustrates the vertical 434 and the corner 436 engaging the pipe 222 to puncture the pipe. In the illustrated embodiment, the pipe 222 is further engaged by the edges 418, 420. However, because the pipe 222 is already punctured, reduced forces may be sufficient to shear the pipe 222. FIG. 5C further illustrates the shearing operation and illustrates that the end diameter 310, which is larger than the pipe diameter 306 is controlled using embodiments of the present disclosure. As a result, the fish may be retrieved and removed from the wellbore.

Figure 6:
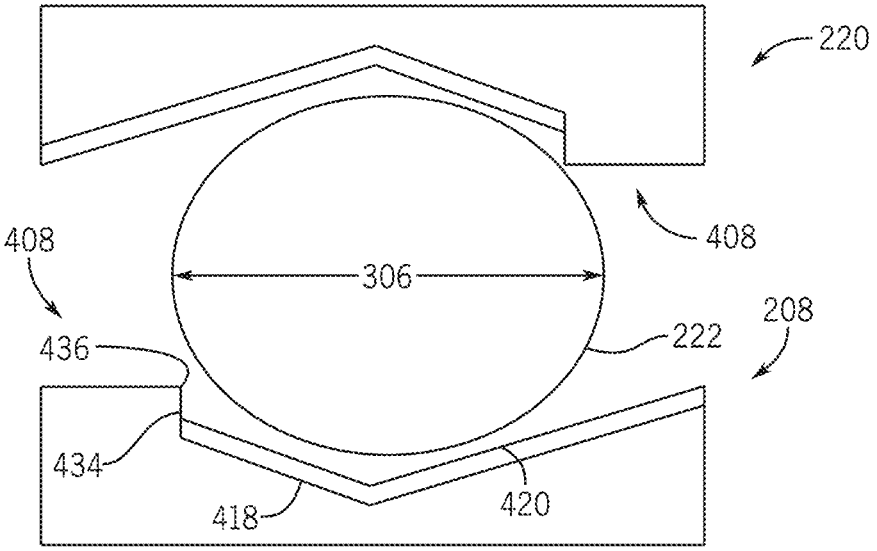
FIG. 6 is a schematic top plan view of an embodiment of a shearing operation, in accordance with embodiments of the present disclosure.

FIG. 6 illustrates a shearing operation 600 where both the upper blade 208 (illustrated as the blade 400) and the lower blade 220 (also illustrated as the blade 400) A are included. As noted above, various features have been removed for clarity. In the illustrated embodiment, the respective flats 408 are arranged at opposite ends of the upper blade 208 and the blower blade 220, thereby puncturing the pipe 222 at opposite ends, as described about. It should be appreciated that embodiments may have the respective flats 408 positioned at the same end such that the flats 408 are aligned.

Embodiments of the present disclosure may be utilized to reduce the spread of pipes that are sheared using a BOP. For example, the blade 400 may include the flat 408 and the vertical 434 to limit expansion by, at least in part, puncturing the pipe 222 prior to shearing. In certain embodiments, shear forces may be reduced utilizing embodiments of the president disclosure due to facilitating both horizontal and vertical rupture of the pipe 222. As a result, either smaller actuators may be used or larger diameter pipes may be sheared.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A blowout preventer (BOP) assembly, comprising:
a body portion;
a bore extending through the body portion;
a ram block assembly, the ram block assembly comprising:
an upper ram block being movable into the bore;
a lower ram block being movable into the bore; and
blades arranged on each of the upper ram block and the lower ram block, the blades including respective asymmetrical blade profiles, with respect to respective longitudinal axes extending through respective midpoints of the blades, the respective blade profiles extending from respective first ends of the blades to respective second ends of the blades, each having a flat positioned to extend from the respective first ends, a first slant, and a second slant positioned to extend to the respective second ends, the first slant being arranged between the flat and the second slant, and the respective longitudinal axes being perpendicular to the respective flats.

2. The assembly of claim 1, wherein the flat extends a flat length, less than the blade length.

3. The assembly of claim 2, wherein the flat length is between one-eighth of the blade length and one-half of the blade length.

4. The assembly of claim 1, wherein the flat includes a vertical section coupled to the first slant, the vertical section extending a flat depth that is less than a blade depth.

5. The assembly of claim 1, wherein the first slant and the second slant are arranged at a slant angle with respect to one another, the first slant and the second slant having opposite slopes.

6. The assembly of claim 1, wherein the flat is arranged to contact a pipe, extending through the bore, before the first slant and the second slant, the flat puncturing the pipe.

7. The assembly of claim 1, wherein the flat does not include a cutting edge.

8. A blade, comprising:
a blade body extending a blade length and having a blade depth, the blade being asymmetrical across the blade length, with respect to a longitudinal axis extending through a midpoint of the blade parallel to the blade depth;
a flat, arranged at a forward face, extending a flat length, less than the blade length, the flat positioned to extend from a first end of the blade body;
at least one slant, arranged at the forward face, the at least one slant being coupled to the flat and positioned at a slant angle, wherein the at least one slant includes a cutting edge; and
a second slant, coupled to the at least one slant, the second slant including a second cutting edge and positioned to extend to a second end of the blade body opposite the first end;
wherein the flat includes a vertical extending between the flat and the at least one slant, the vertical having a flat depth that is less than the blade depth.

9. The blade of claim 8, wherein the slant angle is greater than or equal to 90 degrees.

10. The blade of claim 8, wherein the flat is arranged to contact a pipe, being sheared by the blade, before the at least one slant, the flat puncturing the pipe.

11. The blade of claim 8, wherein the flat length is between one-eighth of the blade length and one-half of the blade length.

12. The blade of claim 8, further comprising:
an aperture for fastening the blade to a ram block.

13. The blade of claim 8, wherein the blade is integrally formed to a ram block.

14. A ram block assembly, comprising:
an upper ram block;
a lower ram block;
an asymmetrical upper blade extending an upper blade length, coupled to the upper ram block, the upper blade being asymmetrical with respect to an upper longitudinal axis extending through an upper midpoint of the upper blade, the upper blade comprising:
an upper flat, the upper flat arranged at a forward face of the upper blade, the upper flat being perpendicular to the upper longitudinal axis, and the upper flat positioned to extend from a first end of the upper blade;
an upper vertical portion of the upper flat;
at least one upper slant, coupled to the upper vertical portion, the at least one upper slant arranged at an upper angle with respect to the upper vertical portion; and a second upper slant, coupled to the at least one upper slant, and positioned to extend to a second end of the upper blade, opposite the first end of the upper blade; and an asymmetrical lower blade extending a lower blade length, coupled to the lower ram block, the lower blade being asymmetrical with respect to a lower longitudinal axis extending through a lower midpoint of the lower blade, the lower blade comprising:

a lower flat, the lower flat arranged at a forward face of the lower blade, the lower flat being perpendicular to the lower longitudinal axis, and the lower flat positioned to extend from a first end of the lower blade;

a lower vertical portion of the lower flat;

at least one lower slant, coupled to the lower vertical portion, the at least one lower slant arranged at a lower angle with respect to the lower vertical portion; and a second lower slant, coupled to the at least one lower slant, and positioned to extend to a second end of the lower blade, opposite the first end of the lower blade.

15. The ram block assembly of claim 14, wherein each of the upper and lower slant angles is greater than or equal to 90 degrees.

16. The ram block assembly of claim 14, wherein an upper flat length is between one-eighth of the upper blade length and one-half of the upper blade length, and a lower flat length is between one-eighth of the lower blade length and one-half of the lower blade length.

17. The ram block assembly of claim 14, wherein the upper flat length and the lower flat lengths are positioned at opposite ends of the respective upper blade and lower blade.

* * * * *